US010627066B2

(12) United States Patent
Takenaga et al.

(10) Patent No.: US 10,627,066 B2
(45) Date of Patent: Apr. 21, 2020

(54) VEHICLE LAMP

(71) Applicant: Koito Manufacturing Co., Ltd., Tokyo (JP)

(72) Inventors: Mai Takenaga, Shizuoka (JP); Kohei Takenaga, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 16/448,177

(22) Filed: Jun. 21, 2019

(65) Prior Publication Data

US 2020/0003383 A1 Jan. 2, 2020

(30) Foreign Application Priority Data

Jun. 28, 2018 (JP) ..... 2018-122651

(51) Int. Cl.

| | |
|---|---|
| ***F21V 9/00*** | (2018.01) |
| ***F21S 41/24*** | (2018.01) |
| ***F21S 41/148*** | (2018.01) |
| *F21W 107/10* | (2018.01) |

(52) U.S. Cl.
CPC ..... *F21S 41/24* (2018.01); *F21S 41/148* (2018.01); *F21W 2107/10* (2018.01)

(58) Field of Classification Search
CPC ..... F21S 41/14–168; F21S 41/24
USPC ..... 362/511, 551–556
See application file for complete search history.

(56) References Cited

FOREIGN PATENT DOCUMENTS

JP 2012-216279 A 11/2012

*Primary Examiner* — Jason M Han
(74) *Attorney, Agent, or Firm* — Abelman, Frayne & Schwab

(57) ABSTRACT

A vehicle lamp includes a first light guide, a second light guide, a first light source, and a second light source. The first light guide includes a first portion extending in a first direction, a second portion extending in a second direction intersecting the first direction, and a third portion shaped to be bent from the first direction to the second direction and interconnecting the first portion and the second portion. The second light guide extends along the first portion and the third portion and has a shape gradually decreasing in a cross-sectional area outside of the bend of the third portion, thereby merging with the light emitting light guide.

4 Claims, 6 Drawing Sheets

VEHICLE LAMP

CROSS-REFERENCE TO RELATED APPLICATIONS

This application is based on and claims priority from Japanese Patent Application No. 2018-122651, filed on Jun. 28, 2018, with the Japan Patent Office, the disclosure of which is incorporated herein in its entirety by reference.

TECHNICAL FIELD

The present disclosure relates to a vehicle lamp, and more particularly, to a vehicle lamp used for a vehicle such as an automobile.

BACKGROUND

In the related art, a vehicle lamp is known, which emits light of a light source toward the front side of the lamp via a light guide. For example, Japanese Patent Laid-Open Publication No. 2012-216279 discloses a structure in which a light source such as an LED is disposed on the end of a rod-shaped light guide and light introduced from the end surface of the light guide is emitted to the front side of a lamp by steps provided on the peripheral surface of the light guide.

SUMMARY

Inventors of the present disclosure have found that there is room for improvement in the utilization efficiency of light in the vehicle lamp of the related art as a result of conducting intensive studies on the vehicle lamp in which light is introduced from the end surface of the rod-shaped light guide and is emitted from the peripheral surface of the light guide.

The present disclosure has been made in consideration of such a circumstance and is to provide a technique that improves the utilization efficiency of light in a vehicle lamp.

In order to achieve the above object, one aspect of the present disclosure is a vehicle lamp. The vehicle lamp includes a first light guide having a rod-shape and configured to emit light, a second light guide having a rod-shape and configured to supply light, a first light source configured to introduce light into the first light guide, and a second light source configured to introduce light into the second light guide. The first light guide includes a first portion extending in a first direction, a second portion extending in a second direction intersecting the first direction, and a third portion shaped to be bent from the first direction to the second direction and interconnecting the first portion and the second portion. The second light guide extends along the first portion and the third portion and has a shape gradually decreasing in a cross-sectional area outside the bend of the third portion, thereby merging with the first light guide. The second light guide introduces the light of the second light source into the first light guide while guiding the light therein. The first light guide emits the light of the first light source and the second light source from the first portion, the third portion, and the second portion while guiding the light therein. According to this aspect, it is possible to improve the utilization efficiency of light in the vehicle lamp.

In the above aspect, the light of the first light source may be introduced into the first light guide from an end surface of the first light guide, and the light of the second light source may be introduced into the second light guide from an end surface of the second light guide. In addition, in any one aspect, the second light guide may have a thickness equal to or less than a thickness of the first light guide.

According to the present disclosure, it is possible to improve the utilization efficiency of light in a vehicle lamp.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
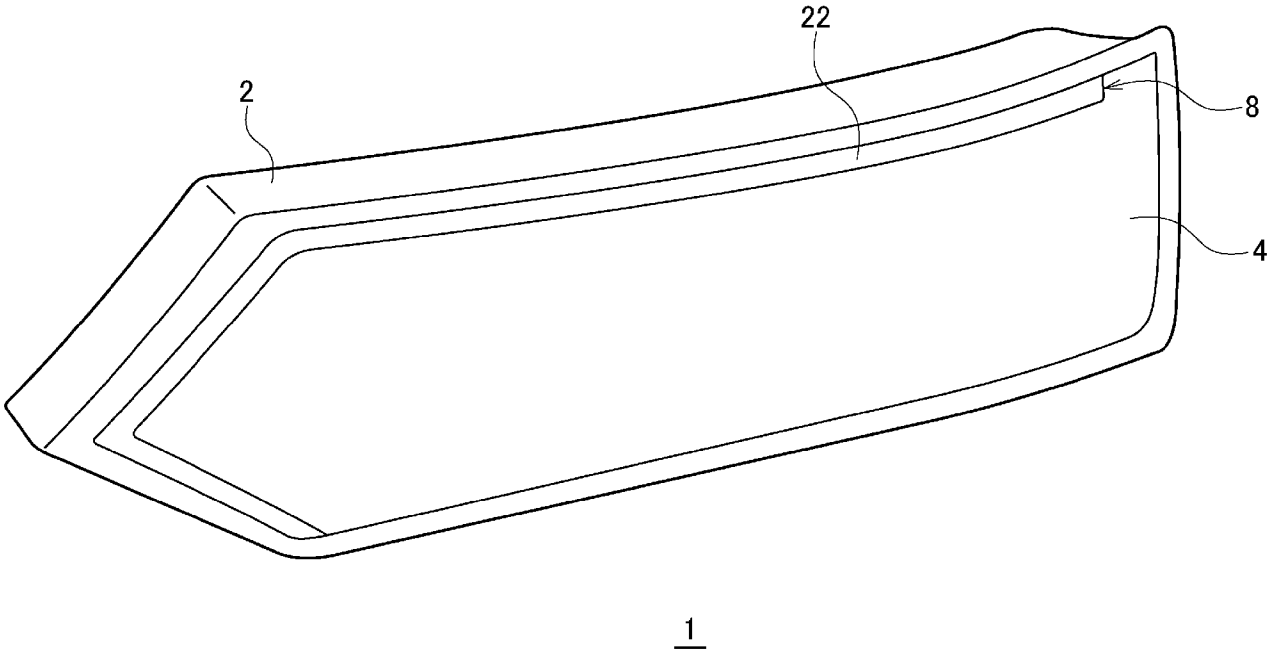
FIG. 1 is a front view illustrating a schematic structure of a vehicle lamp according to a first embodiment.

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, the present disclosure will be described based on an exemplary embodiment with reference to the accompanying drawings. The embodiment is not intended to limit the disclosure and is merely given by way of example, and all features or combinations thereof described in the embodiment may not be necessarily essential to the disclosure. The same or equivalent components, members, and processings illustrated in the respective drawings will be designated by the same reference numerals, and a redundant description will be omitted as appropriate. In addition, the scale or shape of each element illustrated in each drawing is set for convenience for ease of description and is not interpreted in a limited manner unless otherwise stated. In addition, when terms such as "first" and "second" are used in the specification or the claims, these terms do not represent any order or importance unless stated otherwise and are used to distinguish any one element from another element. In addition, in each drawing, a part of a member which is not important in describing the embodiment will not be illustrated.

Figure 2:
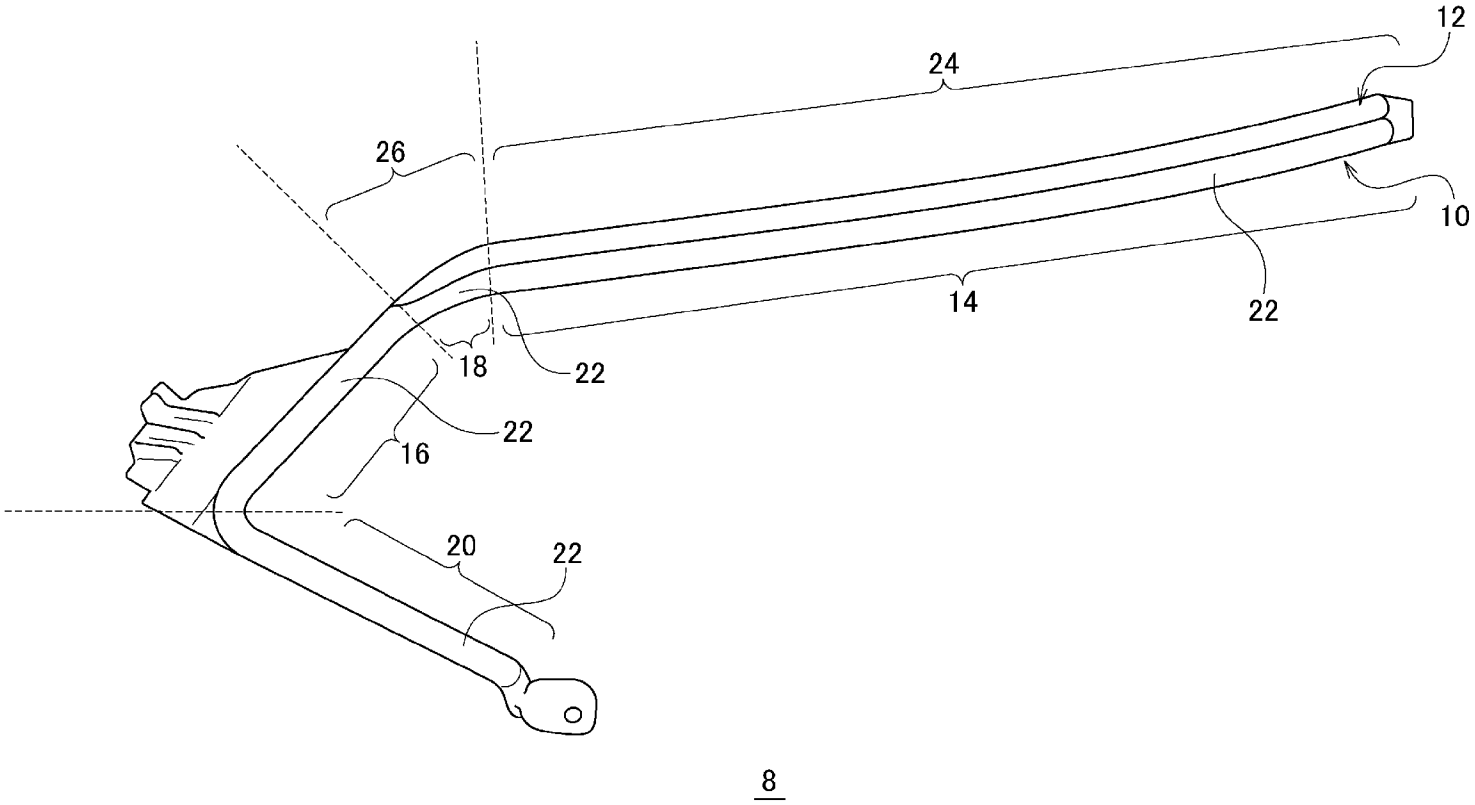
FIG. 2 is a front view illustrating a schematic structure of a light guide.

FIG. 1 is a front view illustrating a schematic structure of a vehicle lamp according to a first embodiment. FIG. 2 is a front view illustrating a schematic structure of a light guide.

Figure 3A:
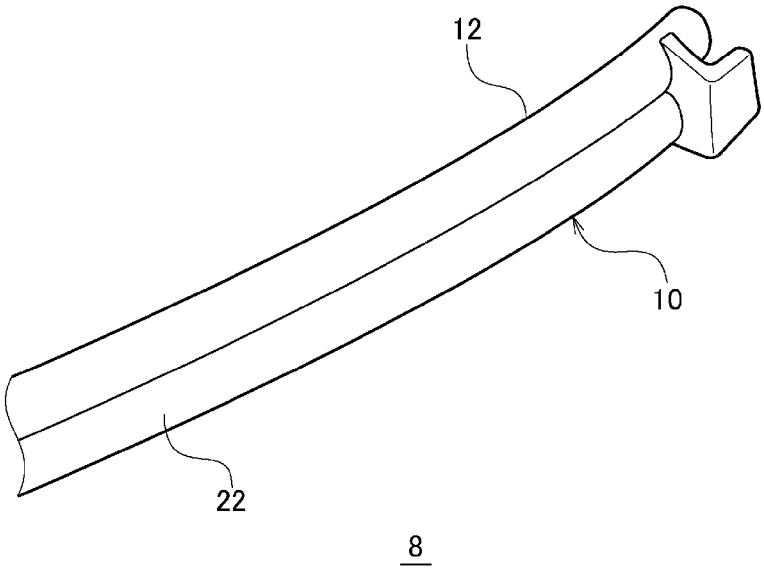
FIG. 3A is a perspective view illustrating an end region of the light guide.
Figure 3B:
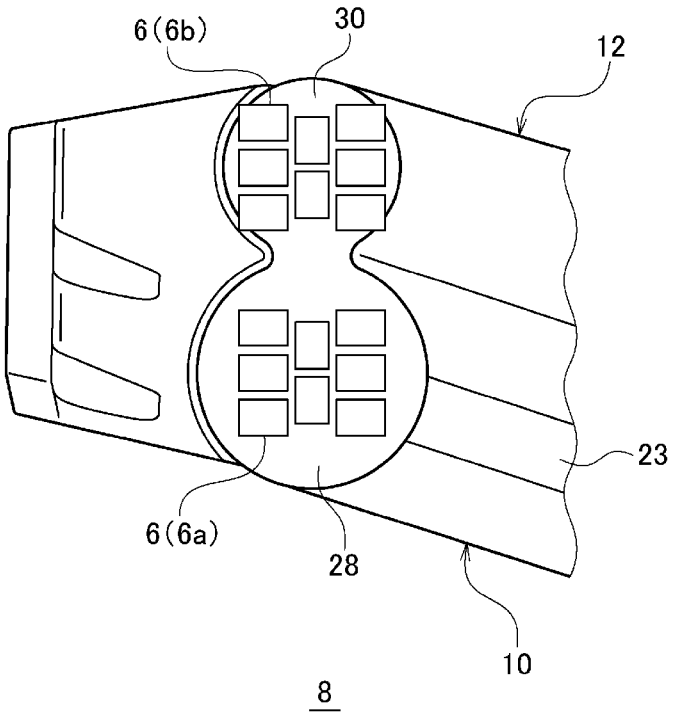
FIG. 3B is a perspective view illustrating an end surface of the light guide.

FIG. 3A is a perspective view illustrating an end region of the light guide. FIG. 3B is a perspective view illustrating an end surface of the light guide. The vehicle lamp 1 according to the present embodiment is, for example, a vehicle headlamp device having a pair of headlamp units disposed on the front left and right sides of a vehicle. Since the pair of headlamp units has an approximately horizontally symmetrical structure and has substantially the same configuration, FIG. 1 illustrates a structure of one of the headlamp units as the vehicle lamp 1.

The vehicle lamp 1 includes a lamp body 2 having an opening on the vehicle front side and a light transmitting outer cover 4 configured to cover the opening in the lamp body 2. A plurality of light sources 6 and a light guide 8 are accommodated in a lamp chamber defined by the lamp body 2 and the outer cover 4.

The light sources 6 are configured with, for example, light emitting diodes (LEDs). In addition, the light sources 6 may be other semiconductor light emitting elements such as laser diodes (LDs) or organic or inorganic electro luminescence (EL) elements, an incandescent bulb, a halogen lamp, or a discharge bulb. A substrate (not illustrated) on which the light sources 6 are mounted is fixed to, for example, the lamp body 2. The light sources 6 include a first light source 6*a* and a second light source 6*b*.

The light guide 8 is a rod-shaped light transmitting member. The light guide 8 includes a rod-shaped light emitting light guide portion 10 and a rod-shaped light supplying light guide portion 12. The entire light guide 8 has a schematic shape in which the light guide 8 extends from the outer side in the vehicle width direction to the inner side in the vehicle width direction at the upper side in the lamp chamber and then turns back to the lower side to be folded to the outer side in the vehicle width direction. The light guide 8 is fixed to the lamp body 2 via a support member (not illustrated). For example, the light guide 8 is formed of a light transmitting resin material such as an acrylic resin or a polycarbonate resin. In the present embodiment, the light emitting light guide portion 10 and the light supplying light guide portion 12 are an integrally molded article.

The light emitting light guide portion 10 includes a first portion 14, a second portion 16, a third portion 18, and a fourth portion 20. The first portion 14 extends in a first direction. In the present embodiment, the first direction is approximately the vehicle width direction. The second portion 16 extends in a second direction intersecting the first direction. In the present embodiment, the second direction is approximately a direction from the outer side in the vehicle width direction and the upper side in the vertical direction to the inner side in the vehicle width direction and the lower side in the vertical direction. The second portion 16 is disposed at the inner side in the vehicle width direction and the lower side in the vertical direction of the first portion 14.

The third portion 18 is shaped to be bent from the first direction to the second direction and interconnects the first portion 14 and the second portion 16. An end of the first portion 14 at the inner side in the vehicle width direction is connected to one end side of the third portion 18, and an end of the second portion 16 at the outer side in the vehicle width direction is connected to the other end side of the third portion 18. The third portion 18 is gently curved or bent so as to be directed to the lower side in the vertical direction with increasing distance from the outer side or decreasing distance to the inner side in the vehicle width direction.

The fourth portion 20 extends in a third direction intersecting the second direction. In the present embodiment, the third direction is approximately a direction from the inner side in the vehicle width direction and the upper side in the vertical direction to the outer side in the vehicle width direction and the lower side in the vertical direction. The fourth portion 20 is connected to an end of the second portion 16 at the inner side in the vehicle width direction, and extends from the aforementioned end to the outer side in the vehicle width direction and to the lower side in the vertical direction. In the present embodiment, the angle formed by the second portion 16 and the fourth portion 20 is approximately a right angle or an acute angle.

A region of the peripheral surface of the light emitting light guide portion 10 that faces the lamp front side configures an emission surface 22 from which light of the light sources 6 is emitted. The peripheral surface is a surface that extends along the extension axis (central axis in the extension direction) of a rod-shaped member. That is, the light emitting light guide portion 10 has the emission surface 22 shaped in such a manner that the emission surface 22 extends from the outer side to the inner side in the vehicle width direction and turns back from the inner side in the vehicle width direction to the lower side in the vertical direction to be folded to the outer side in the vehicle width direction. An optical structure 23 is provided on the peripheral surface of the light emitting light guide portion 10 that faces the lamp rear side to emit the light in the light emitting light guide portion 10 from the emission surface 22. In the present embodiment, the optical structure 23 is composed of a plurality of reflective steps. The light emitting light guide portion 10 emits the light of the light sources 6 from the emission surface 22 by the optical structure 23 while guiding the light therein. The emission surface 22 is visible as a light emitting portion from the outside of the lamp.

The light supplying light guide portion 12 extends along the first portion 14 and the third portion 18 of the light emitting light guide portion 10. The light supplying light guide portion 12 is in contact with the first portion 14 and the third portion 18 of the light emitting light guide portion 10 at the respective peripheral surfaces thereof. Specifically, the light supplying light guide portion 12 includes a fifth portion 24 extending along the first portion 14 and a sixth portion 26 extending along the third portion 18. The fifth portion 24 of the present embodiment extends along the first portion 14 at the upper side in the vertical direction of the first portion 14. In addition, the sixth portion 26 extends along the third portion 18 at the upper side in the vertical direction of the third portion 18. Thus, the sixth portion 26 extends at the outer side of a curve of the third portion 18.

The thickness of the light supplying light guide portion 12 may be equal to or less than the thickness of the light emitting light guide portion 10. For example, the average value of the thickness of the light supplying light guide portion 12 is equal to or less than the average value of the thicknesses of the first portion 14 and the second portion 16 in the light emitting light guide portion 10. In other words, the average value of the cross-sectional areas perpendicular to the extension axis of the light supplying light guide portion 12 is equal to or less than the average value of the cross-sectional areas perpendicular to the extension axes of the first portion 14 and the second portion 16.

The first light source 6*a* is disposed on an end of the light emitting light guide portion 10. In the present embodiment, a plurality of first light sources 6*a* are disposed on the end of the light emitting light guide portion 10 at the outer side in the vehicle width direction. Each first light source 6*a* is disposed such that a light emitting surface thereof faces an end surface 28 of the light emitting light guide portion 10. Thus, light of each first light source 6*a* is introduced into the light emitting light guide portion 10 from the end surface 28 of the light emitting light guide portion 10. The end surface is a surface that extends in a direction intersecting the extension axis at the end of a rod-shaped member.

The second light source 6*b* is disposed on an end of the light supplying light guide portion 12. In the present embodiment, a plurality of second light sources 6*b* are disposed on the end of the light supplying light guide portion 12 at the outer side in the vehicle width direction. Each second light source 6*b* is disposed such that a light emitting surface thereof faces an end surface 30 of the light supplying light guide portion 12. Thus, light of each second light source 6*b* is introduced into the light supplying light guide portion 12 from the end surface 30 of the light supplying light guide portion 12.

Figure 4A:
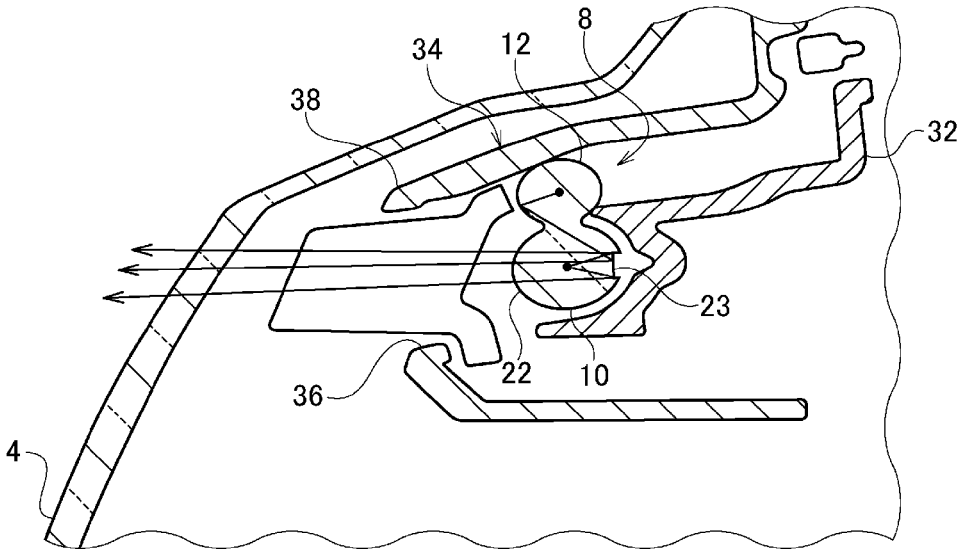
FIG. 4A is a vertical cross-sectional view illustrating a schematic structure of a part of the vehicle lamp.
Figure 4B:
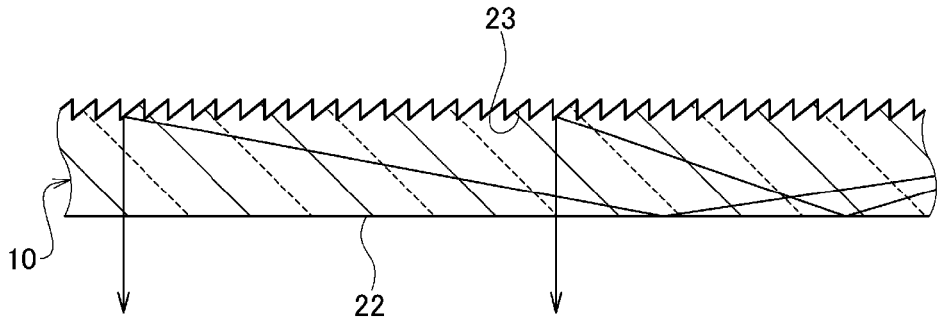
FIG. 4B is a horizontal cross-sectional view illustrating a schematic structure of a part of a light emitting light guide portion.

FIG. 4A is a vertical cross-sectional view illustrating a schematic structure of a part of the vehicle lamp. FIG. 4B is a horizontal cross-sectional view illustrating a schematic structure of a part of the light emitting light guide portion. The light guide 8 is fitted into a holder 32 and is supported by the lamp body 2. The holder 32 covers the peripheral surface of the light emitting light guide portion 10 on the lamp rear side. The holder 32 also functions as a reflector.

In addition, the vehicle lamp 1 includes an extension member 34. The extension member 34 is disposed so as to surround the light guide 8 and is fixed to the lamp body 2. The extension member 34 has an opening 36 which allows the light emitted from the emission surface 22 to advance toward to the front side of the lamp. An edge 38 of a part of the opening 36 is disposed so as to overlap at least a part of the light supplying light guide portion 12 when viewed from the front side of the lamp. Thus, at least a part of the light supplying light guide portion 12 may be hidden from the outside of the lamp. As a result, the design and appearance of the vehicle lamp 1 may be improved.

The light supplying light guide portion 12 introduces the light of the second light source 6*b* into the light emitting light guide portion 10 while guiding the light therein. The light of the second light source 6*b* is introduced from the end surface 30 of the light supplying light guide portion 12, repeats internal reflection in the light supplying light guide portion 12, and advances to the opposite side end. In this process, the light of the second light source 6*b* is gradually introduced into the light emitting light guide portion 10 from a region in which the peripheral surface of the light supplying light guide portion 12 and the peripheral surface of the light emitting light guide portion 10 are in contact with each other. The light supplying light guide portion 12 does not have the optical structure 23. Thus, substantially all of the light in the light supplying light guide portion 12 is introduced into the light emitting light guide portion 10.

The light emitting light guide portion 10 emits the light of the first light source 6*a* and the second light source 6*b* from the first portion 14, the third portion 18, and the second portion 16 while guiding the light therein. The light of the first light source 6*a* is introduced from the end surface 28 of the light emitting light guide portion 10, repeats internal reflection in the light emitting light guide portion 10, and advances to the opposite side end. In addition, the light of the second light source 6*b* from the light supplying light guide portion 12 is introduced into the first portion 14 and the third portion 18 of the light emitting light guide portion 10. The light of the second light source 6*b* introduced into the light emitting light guide portion 10 also repeats internal reflection, together with the light of the first light source 6*a*, in the light emitting light guide portion 10. The light of the first light source 6*a* and the second light source 6*b* advances to a connection portion of the second portion 16 and the fourth portion 20.

A part of the light of the first light source 6*a* and the second light source 6*b* advancing in the light emitting light guide portion 10 is reflected by the optical structure 23. Thus, the light is emitted from the emission surface 22 of the first portion 14, the third portion 18, and the second portion 16 to the outside of the light emitting light guide portion 10. The light emitted from the emission surface 22 passes through the outer cover 4 and is irradiated to the front side of the lamp.

The light supplying light guide portion 12 is not a light guide portion intended for light emission but a light guide portion for supplying light to the light emitting light guide portion 10. By supplying the light of the second light source 6*b* from the light supplying light guide portion 12 to the light emitting light guide portion 10, the amount of light emitted from the emission surface 22 may be increased. In addition, the light source 6 is further disposed on the end of the light emitting light guide portion 10 opposite to the end surface 28. The light emitted from the light source 6 is mainly emitted from the emission surface 22 of the fourth portion 20.

Figure 5:
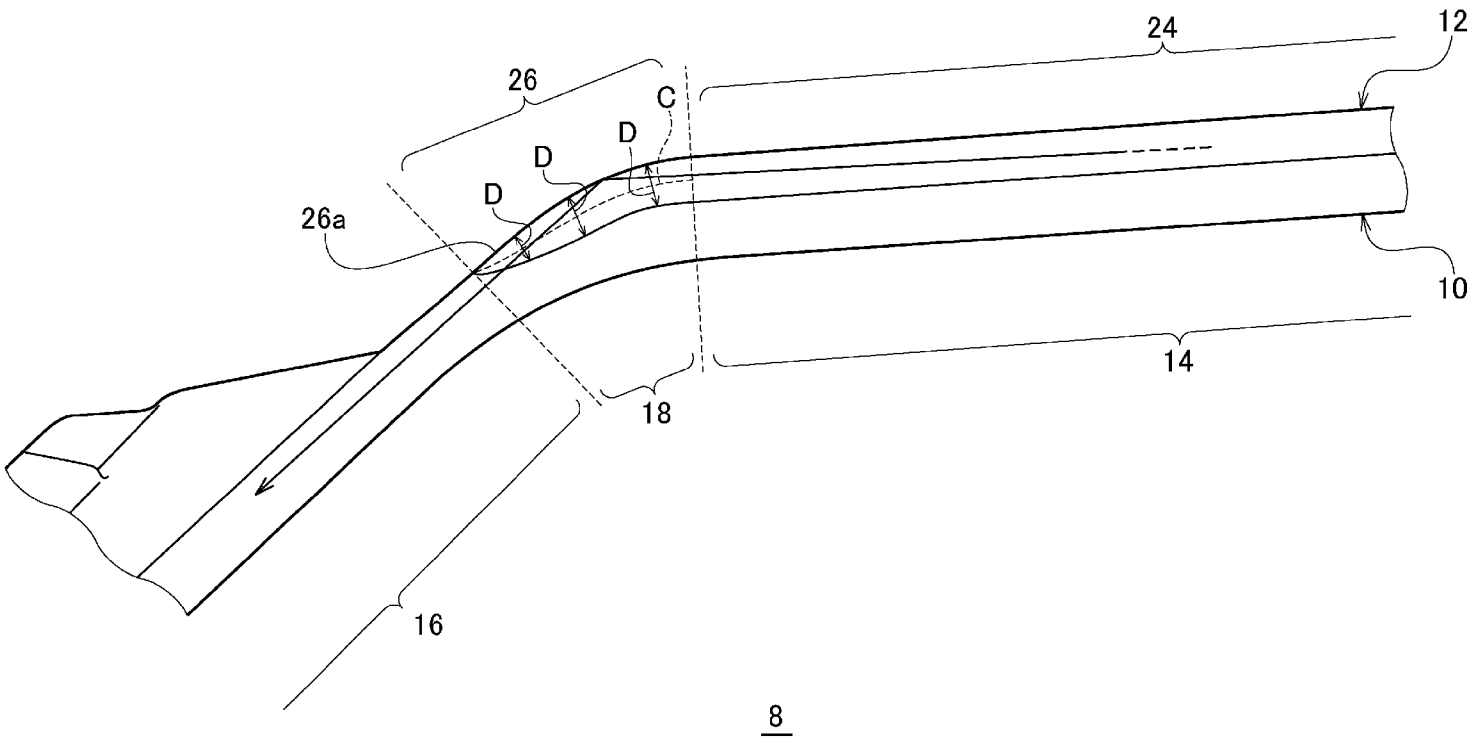
FIG. 5 is an enlarged front view illustrating a part of the light guide.

Subsequently, the shape of a merging portion of the light supplying light guide portion 12 and the light emitting light guide portion 10 will be described in detail. FIG. 5 is an enlarged front view illustrating a part of the light guide. The light supplying light guide portion 12 has a shape in which a cross-sectional area D gradually decreases at the outer side of the curve of the third portion 18 so that the light supplying light guide portion 12 merges with the light emitting light guide portion 10. Specifically, the sixth portion 26 of the light supplying light guide portion 12 is shaped such that the cross-sectional area D perpendicular to the extension axis C of the sixth portion 26 gradually decreases toward the downstream side of light guidance in the light supplying light guide portion 12, i.e., with increasing distance from the fifth portion 24.

The thickness of the sixth portion 26 (the distance between one peripheral surface that is in contact with the third portion 18 and the other peripheral surface that faces away from the one peripheral surface) gradually decreases at the outer side of the curve of the third portion 18. In other words, a peripheral surface 26*a* of the sixth portion 26 opposite to the light emitting light guide portion 10 approaches the light emitting light guide portion 10 toward the downstream side of light guidance. Therefore, the peripheral surface 26*a* is a surface that is inclined with respect to the peripheral surface of the third portion 18. The direction in which the peripheral surface 26*a* is inclined is the direction toward the third portion 18. In addition, the peripheral surface 26*a* of the present embodiment is curved with a curvature larger than that of the third portion 18. Thus, the light of the second light source 6*b* entering the sixth portion 26 from the fifth portion 24 is reflected by the peripheral surface 26*a* toward the bending direction of the third portion 18, i.e., the second direction in which the second portion 16 extends.

Figure 6A:
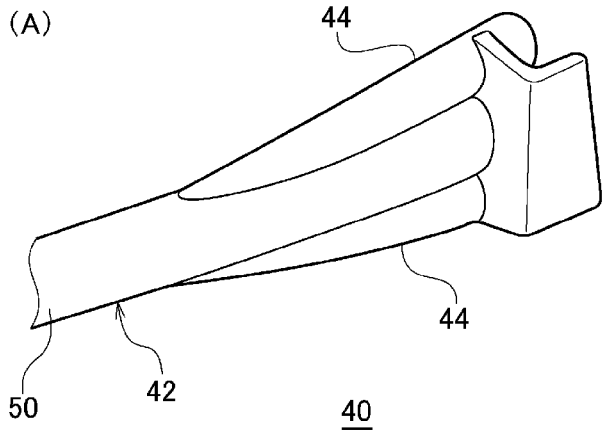
FIG. 6A is a perspective view illustrating an end region of a light guide according to a reference example.
Figure 6B:
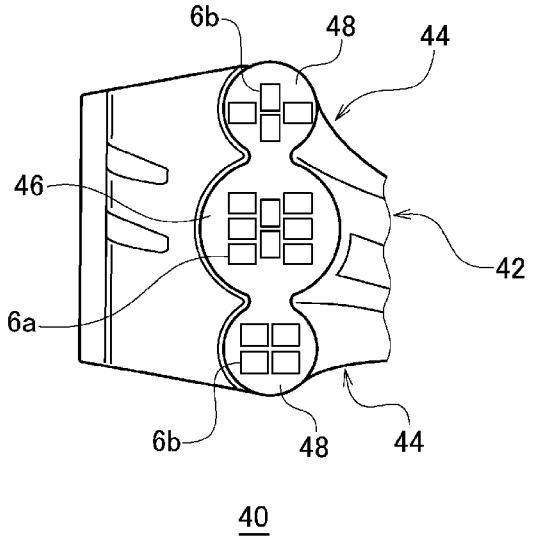
FIG. 6B is a perspective view illustrating an end surface of the light guide according to the reference example.
Figure 6C:
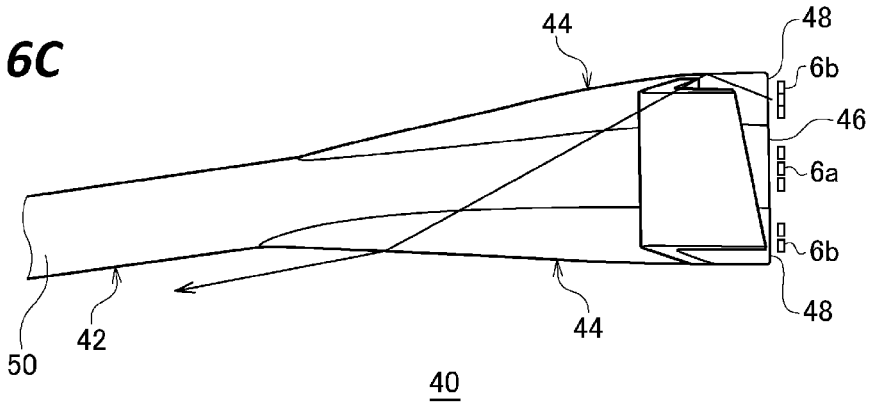
FIG. 6C is a schematic view illustrating the advancing direction of light in the light guide according to the reference example.

FIG. 6A is a perspective view illustrating an end region of a light guide according to a reference example. FIG. 6B is a perspective view illustrating an end surface of the light guide according to the reference example. FIG. 6C is a schematic view illustrating the advancing direction of light in the light guide according to the reference example. In a structure in which light is introduced from the end surface of a rod-shaped light guide, a desired luminous intensity of light may not be obtained with the number of light sources that may be disposed on the end surface of one light guide.

In order to solve this problem, it is conceivable to devise the shape of the light guide so as to increase the number of light sources that may be provided. The light guide 40 according to the reference example includes, at the end of a light emitting light guide portion 42, a light incident portion 44 branched from the light emitting light guide portion 42. Then, the plurality of first light sources 6*a* are disposed on an end surface 46 of the light emitting light guide portion 42, and the plurality of second light sources 6*b* are disposed on an end surface 48 of the light incident portion 44.

The light emitted from the second light sources 6*b* is introduced into the light incident portion 44 from the end surface 48 and is guided by the light incident portion 44 to be introduced into the light emitting light guide portion 42. The light emitted from the first light sources 6*a* is introduced into the light emitting light guide portion 42 from the end surface 46. The light emitting light guide portion 42 emits the light of the first light sources 6*a* and the second light sources 6*b* from an emission surface 50 while guiding the light therein.

In the light guide 40 according to the reference example, the amount of light emitted from the emission surface 50 is increased by introducing the light of the second light source 6*b* from the branched light incident portion 44 to the end of the light emitting light guide portion 42. However, in a structure in which the light incident portion 44 is provided on the end of the light emitting light guide portion 42, in many cases, the light incident portion 44 merges with the light emitting light guide portion 42 at a straight portion of the light emitting light guide portion 42. In this case, as illustrated in FIG. 6C, the light internally reflected from the peripheral surface of the light incident portion 44 may leak to the outside of the light guide 40.

Meanwhile, in the light guide 8 of the present embodiment, the light supplying light guide portion 12 merges with the light emitting light guide portion 10 in the third portion 18 which is shaped to be bent from the first direction in which the first portion 14 extends to the second direction in which the second portion 16 extends. Thus, in the merging portion of the light emitting light guide portion 10 and the light supplying light guide portion 12, the light in the light supplying light guide portion 12 may be guided to the second portion 16. Therefore, in the merging portion, it is possible to prevent the light of the second light source 6*b* from leaking to the outside of the light guide 8. Thus, most of the light of the second light source 6*b* advancing in the light supplying light guide portion 12 may be introduced into the light emitting light guide portion 10.

The vehicle lamp 1 may function as a marker lamp such as a turn signal lamp, a daytime running lamp, or a clearance lamp by emitting light from the emission surface 22 of the light emitting light guide portion 10. In addition, the vehicle lamp 1 may also be used as a headlamp. In addition, the vehicle lamp 1 may be disposed on the rear of the vehicle and used as, for example, a tail lamp or a brake lamp.

As described above, the vehicle lamp 1 according to the present embodiment includes the rod-shaped light emitting light guide portion 10, the rod-shaped light supplying light guide portion 12, the first light source 6*a* which introduces light into the light emitting light guide portion 10, and the second light source 6*b* which introduces light into the light supplying light guide portion 12. The light emitting light guide portion 10 includes the first portion 14 extending in the first direction, the second portion 16 extending in the second direction intersecting the first direction, and the third portion 18 shaped to be bent from the first portion 14 to the second portion 16 and interconnecting the first portion 14 and the second portion 16. The light supplying light guide portion 12 extends along the first portion 14 and the third portion 18 and has a shape in which the cross-sectional area D gradually decreases at the outer side of the curve of the third portion 18 so that the light supplying light guide portion 12 merges with the light emitting light guide portion 10. The light supplying light guide portion 12 introduces the light of the second light source 6*b* into the light emitting light guide portion 10 while guiding the light therein. The light emitting light guide portion 10 emits the light of the first light source 6*a* and the second light source 6*b* from the first portion 14, the third portion 18, and the second portion 16 while guiding the light therein.

Therefore, it is possible to prevent the light in the light supplying light guide portion 12 from leaking from the light guide 8 in the merging portion of the light emitting light guide portion 10 and the light supplying light guide portion 12. Therefore, the amount of light emitted from the emission surface 22 of the light emitting light guide portion 10 may be increased and the utilization efficiency of light in the vehicle lamp 1 may be improved. In addition, the appearance of the vehicle lamp 1 may be improved by preventing the leakage of light.

In addition, in the present embodiment, the light of the first light source 6*a* is introduced into the light emitting light guide portion 10 from the end surface 28 of the light emitting light guide portion 10. In addition, the light of the second light source 6*b* is introduced into the light supplying light guide portion 12 from the end surface 30 of the light supplying light guide portion 12. Therefore, the light of the light source 6 may be introduced without adding the shape of a light incident portion to the light guide 8. Therefore, it is possible to prevent the shape of the light guide 8 from being complicated. In addition, in a structure in which light is introduced from the end surface of a rod-shaped light guide, it is not easy to cause an elongated light emitting surface to emit light uniformly. Meanwhile, in the present embodiment, since light is supplied from the light supplying light guide portion 12 which extends along the light emitting light guide portion 10 to the light emitting light guide portion 10, the luminous intensity of light may be made uniform.

In addition, in the present embodiment, the thickness of the light supplying light guide portion 12 is equal to or less than the thickness of the light emitting light guide portion 10. Thus, the light supplying light guide portion 12 may be merged with the light emitting light guide portion 10 without difficulty. As a result, it is possible to further prevent the leakage of light in the merging portion.

The embodiment of the present disclosure has been described above in detail. The embodiment described above merely shows a specific example for implementation of the present disclosure. The content of the embodiment is not intended to limit the technical scope of the present disclosure, and many design changes such as change, addition, and omission of components are possible without departing from the spirit of the disclosure defined in the claims. In the above-described embodiment, the content in which such design changes are possible is emphasized with a notation such as "of the present embodiment" or "in the present embodiment", but design changes are also acceptable in the content with no notation. Any combination of the above components is also effective as an aspect of the present disclosure. Hatching applied to the cross section of the drawing does not limit the material of a hatched object.

The light guide 8 of the embodiment includes the fourth portion 20, but the fourth portion 20 may be omitted. In addition, the arrangement and the number of light sources 6 are also not limited to those illustrated in FIG. 3B. Arbitrary combinations of the above-described components and conversions of the expression of the present disclosure between a method, an apparatus, and a system, for example, are also effective as aspects of the present disclosure.

What is claimed is:

1. A vehicle lamp comprising:

a first light guide having a rod-shape and configured to emit light;

a second light guide having a rod-shape and configured to supply light;

a first light source configured to introduce light into the first light guide; and a second light source configured to introduce light into the second light guide, wherein the first light guide includes a first portion extending in a first direction, a second portion extending in a second direction intersecting the first direction, and a third portion shaped to be bent from the first direction to the second direction and interconnecting the first portion and the second portion, the second light guide extends along the first portion and the third portion and has a shape gradually decreasing in a cross-sectional area outside the bend of the third portion, thereby merging with the first light guide, the second light guide introduces the light of the second light source into the first light guide while guiding the light therein, and the first light guide emits the light of the first light source and the second light source from the first portion, the third portion, and the second portion while guiding the light therein.

2. The vehicle lamp according to claim 1, wherein the light of the first light source is introduced into the light emitting first light guide from an end surface of the first light guide, and the light of the second light source is introduced into the second light guide from an end surface of the second light guide.

3. The vehicle lamp according to claim 1, wherein the second light guide has a thickness equal to or less than a thickness of the first light guide.

4. The vehicle lamp according to claim 2, wherein the second light guide has a thickness equal to or less than a thickness of the first light guide.

* * * * *